United States Patent [19]

Webb

[11] 4,016,967

[45] Apr. 12, 1977

[54] DECODING MEANS WITH ERROR INHIBITOR FOR USE WITH A TYPEWRITER

[75] Inventor: William E. Webb, Hoffman Estates, Ill.

[73] Assignee: Hamilton Communications, Inc., Schaumburg, Ill.

[22] Filed: Nov. 18, 1975

[21] Appl. No.: 632,924

[52] U.S. Cl. ..... 197/19; 197/98

[51] Int. Cl.[2] ..... B41J 5/08

[58] Field of Search ..... 197/16, 17, 18, 19, 197/20, 97, 98; 178/17 R, 17 C; 340/365 R, 365 S, 365 E; 235/145 R; 335/205–207

[56] References Cited

UNITED STATES PATENTS

| | | | |
|---|---|---|---|
| 3,060,272 | 10/1962 | Bacon et al. | 197/19 |
| 3,233,715 | 2/1966 | Flieg | 197/19 |
| 3,721,327 | 3/1973 | Werf et al. | 197/16 X |
| 3,818,441 | 6/1974 | Nomiya et al. | 340/365 E X |
| 3,872,468 | 3/1975 | Giolitti et al. | 340/365 E X |
| 3,892,915 | 7/1975 | Budworth et al. | 197/19 X |

FOREIGN PATENTS OR APPLICATIONS

| | | | |
|---|---|---|---|
| 1,113,946 | 9/1961 | Germany | 197/97 |

*Primary Examiner*—Edgar S. Burr
*Assistant Examiner*—Paul T. Sewell
*Attorney, Agent, or Firm*—Fitch, Even, Tabin & Luedeka

[57] ABSTRACT

Apparatus is disclosed for attachment to a standard typewriter for selectively actuating one or more of a plurality of magnetically actuated switches to provide unique electrical signals that can be recorded or otherwise used to transmit information. The information electrical signals are produced in response to actuation of the typewriter key and an opto-electronic switching circuit is utilized to prohibit the generation of the electrical signals unless and until a type head strikes the platen. Reed switches and actuating levers are provided for each of the unique keys of the typewriter so that signals identifying the corresponding character or function can be produced.

9 Claims, 6 Drawing Figures

FIG. 2
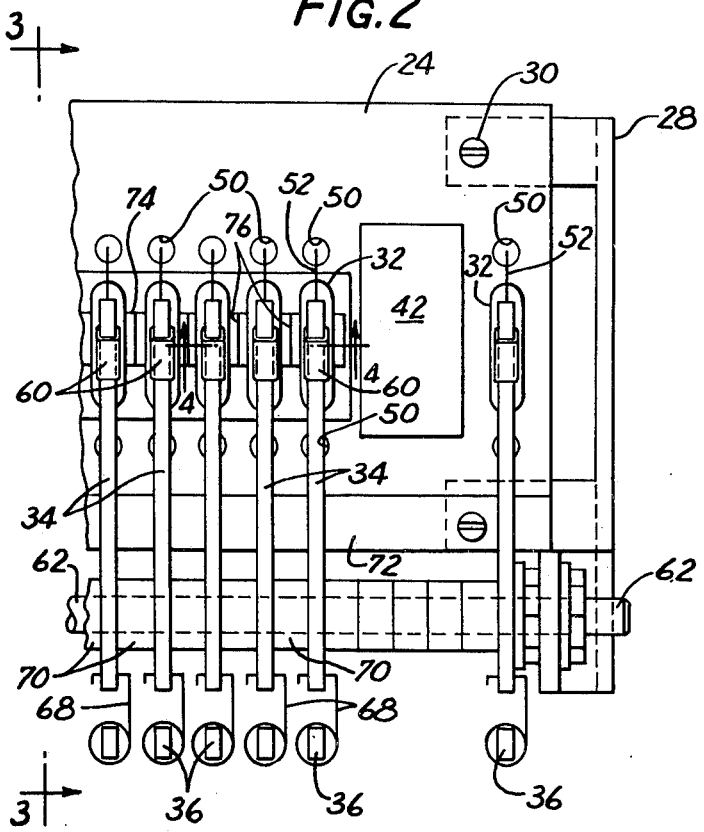
FIG. 3
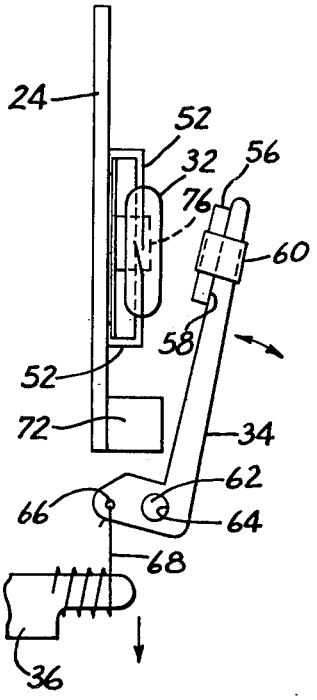
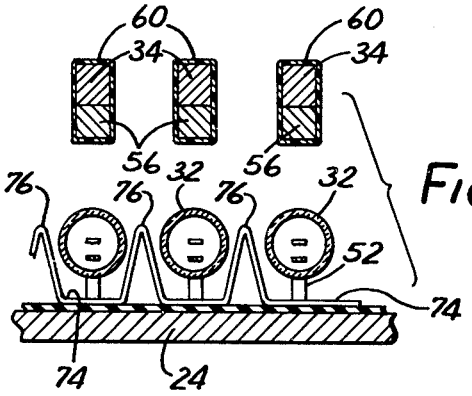
FIG. 4

DECODING MEANS WITH ERROR INHIBITOR FOR USE WITH A TYPEWRITER

The present invention generally relates to apparatus for translating mechanical information into electrical information and, more specifically, to apparatus for attachment to a conventional typewriter for producing electrical signal information corresponding to the characters that are being typed.

Although there has been an extensive proliferation of different types of transmission systems for sending and receiving information between different geographical locations to meet the burgeoning needs of business and governments, many of the conventional systems in use, such as TWX, telegrams, facsimile and computer printer terminals have one or more of the disadvantages of the high cost of equipment purchased or rental, or the unusually long periods that are required for information transmission over a telephone system which is the case of most teleprinters and facsimile reproductions. Moreover, the terminal is typically not operational as a typewriter that can be used as such when not preparing copies for transmission. Additionally, other systems require unusually inconvenient and expensive information processing to place the informaton in the proper form for transmission or reception or both.

While the advantages of rapid transmission and correspondingly lower telephone costs may be balanced against the typically larger cost of purchasing or renting more sophisticated equipment that transmits and receives at high speed, there is a growing need for apparatus that would require virtually no extraordinary processing of information prior to transmission and would rapidly transmit the information over the telephone lines, particularly if such advantages could be coupled with typewriter equipment that is relatively inexpensive to purchase or rent.

This is particularly true for an organization that would have a relatively large network of offices located in many diverse geographic areas and which requires transmission of information within the network. For example, in the event a central office or processing center must receive information for immediate processing from the field offices, such as sales orders, invoices, purchase orders, inventory reports, production schedules, critical news or business reports and the like, it is desirable to have a system for rapidly transmitting such information at a low overall cost.

Accordingly, it is a primary object of the present invention to provide an improved apparatus for use in a transmission system which sends information signals over the telephone system at high speed, which is adapted to be attached to a conventional typewriter and produce electrical matrix signals that uniquely identify the character information that is being typed.

Another object of the present invention is to insure that the electrical matrix signals that are produced are a result of an actual character that is typed or functional operation that is occurring on the typewriter, rather than false spurious electrical signals that could result from a partial depressing of the keys without causing a mechanical operation of the typewriter.

Other objects and advantages of the present invention will become apparent upon reading the following detailed description, in conjunction with the attached drawings in which:

FIG. 2 is plan view of a portion of the apparatus shown in FIG. 1;

FIG. 3 is an end view taken generally in the direction of the arrows 3—3 shown in FIG. 2;

FIG. 4 is a cross-section taken generally along the line 4—4 of FIG. 2;

Figure 1:
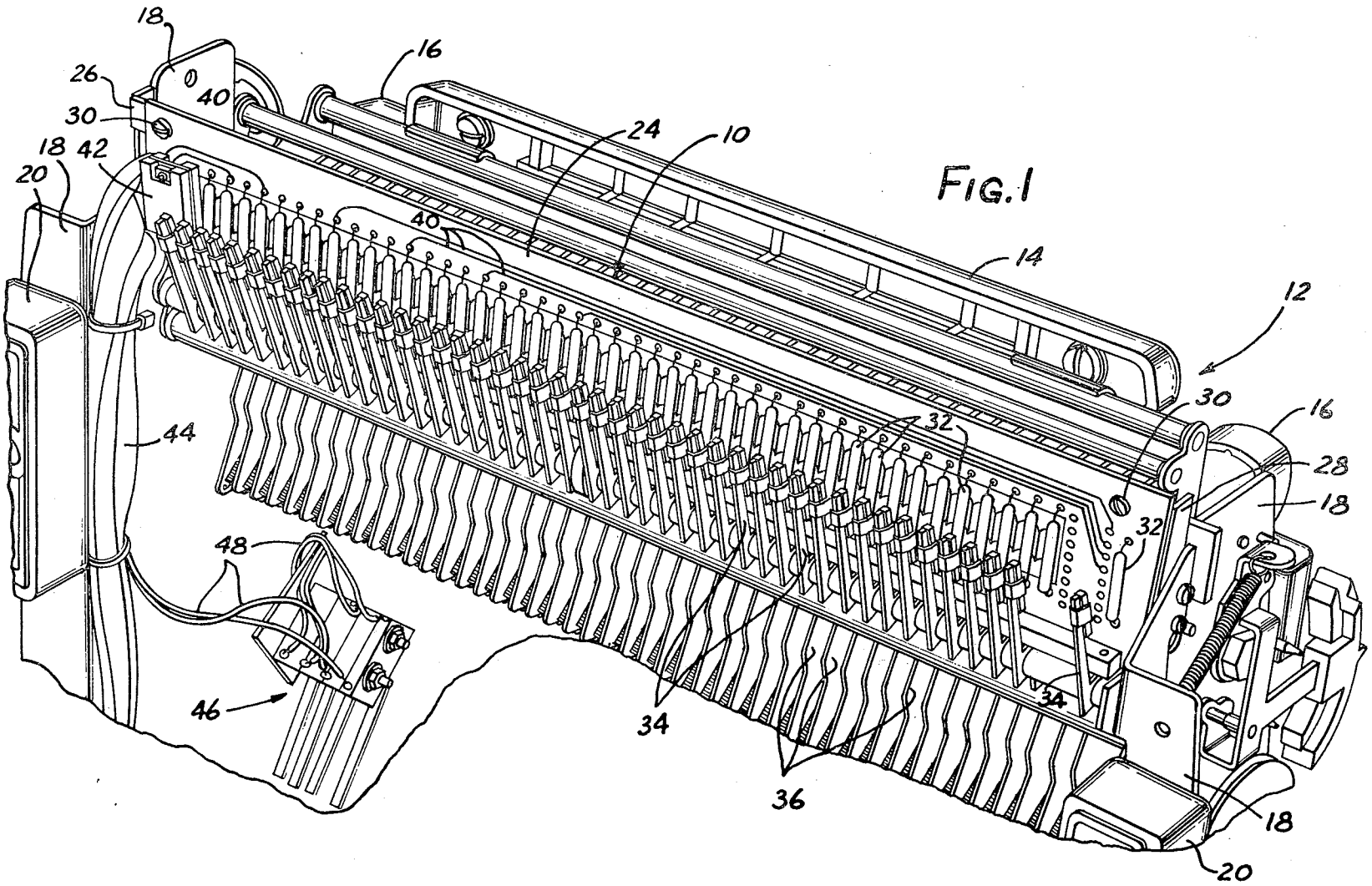
FIG. 1 is a partial perspective view of the underside of the keyboard portion of a typewriter, shown together with apparatus embodying the present invention.

Broadly stated, the present invention is related to U.S. Pat. No. 3,972,403, of which I am a coinventor, that patent being assigned to the same assignee as the present invention. As is set forth therein, apparatus is disclosed that is adapted to be operatively connected to a conventional typewriter which adapts the typewriter for use in providing electrical signals that can be recorded on a magnetic recording device or the like for subsequent local processing or transmission over telephone lines, as desired. The apparatus utilizes a plurality of small switches, each of which can generate a signal that is at least partially indicative of a particular key or functional condition when that switch is actuated. By connecting the switches in electrical circuits that are conventionally matrixed, striking or depressing an individual key will generate unique signals which will identify the key or character struck and this signal is recorded or otherwise stored by appropriate devices. The recorded information can be transmitted and subsequently converted to useable form when received. The apparatus disclosed therein may be easily installed on the underside of the typewriter beneath the keyboard which, because of the compactness of the design, does not detract from the normal appearance of the typewriter. The only change in the outward appearance of the typewriter is the presence of a relatively small connector and electrical conductor cable that interconnects the typewriter to separate conventional cassette recording apparatus or other recording or storage devices. Because of the compact design of the apparatus, it is easily installed in a typewriter with a minimum of difficulty and time.

More specifically the apparatus disclosed in U.S. Pat. No. 3,972,403, is intended to function in a data transmission system that incorporates the cassette recording device or other storage device on which a message can be recorded or stored concurrently as it is being typed on a typewriter. The apparatus is attached to the typewriter and has a plurality of electrical circuits that are individually responsive to actuation of respective typewriter keys and bars. Proper matrixing of the circuits produces unique signals which identify each of the characters or functions and the signals are recorded on a magnetic tape cassette or other storage device. Thus, a signal identifying each character can be recorded when the corresponding typewriter key is depressed and the recorded information can subsequently be "batch" sent at high speed through the telephone system to other geographic locations or used locally for processing.

In accordance with the present invention, means are provided for insuring that a unique electrical signal corresponding to the key being depressed is not produced unless the character is actually typed by the key that is struck or a function, such as a space, back space, tab, shift or the like is actually carried out. As will be more fully described hereinafter, the manner in which the electrical signals are produced when the switches are actuated often permits the possibility that a spurious or undesirable signal indication can be generated, even though the corresponding character may not be actually typed on the paper by the typewriter. In other words, typists sometimes rest their fingers somewhat heavily on the keyboard to a degree such that the electrical switch may be actuated, but the typewriter may not type. As will be described, the present invention utilizes electrical circuitry as well as a machine actuated enabling signal which inhibits electrical signals of a particular character or function unless that function is being mechanically carried out by the typewriter.

Turning now to the drawings, and particularly FIGS. 1–4, apparatus similar to that disclosed in the aforementioned U.S. Pat. No. 3,972,403 is illustrated generally at 10, and is shown in its operating environment, having been attached to the underside of a conventional typewriter 12 beneath the keyboard thereof. While the particular perspective view shown in FIG. 1 fails to illustrate the complete keyboard of the typewriter, the underside of a spacer bar 14 is clearly visible as are shift keys 16. The typewriter structural frame members 18 and portions of the feet 20 are also illustrated.

The apparatus 10 includes a relatively long flat mounting board 24 extending generally the full width of the typewriter keyboard and is fastened to mounting brackets 26 and 28 located on opposite ends of the keyboard by screws 30. The mounting brackets 26 and 28 are similarly attached to the frame members 18 of the typewriter and firmly hold the mounting board 24 in the illustrated position. The apparatus 10 includes a plurality of switches 32 arranged adjacent one another along the length of the mounting board 24 and extending generally the full width of the typewriter keyboard. Each of the switches 32 is operably connected to an electrical circuit and the switches are actuated by respective pivotable actuating levers 34 so that a portion of the actuating levers are brought into close proximity to the individual switches 32. The actuating levers are mechanically connected to linkage members 36 associated with each of the keys of the typewriter key mechanism so that striking of a typewriter key will cause its corresponding linkage member 36 to pivot the interconnected actuating lever 34 into close proximity to its associated switch 32 and thereby actuate the same to produce an electrical signal in the circuit. Since each of the keys of the typewriter, including space bars, shift levers and the like, preferably have a separate circuit associated therewith, proper electrical matrixing of the circuits can provide exact identification of the characters and function being typed and permits reliable recording and subsequent reproduction of the information. In this regard, the use of the American Standard Code for Information Interchange (ASCII) may be used, the code having a matrix of four columns by 16 rows to generate the necessary binary coded information. In this regard, six bits of binary information are sufficient to generate the information content of the ASCII Code.

A mounting board 24 provides a mounting surface for the switches 32 and is also a printed circuit board for printing electrical conductors using conventional printed circuit board fabricating techniques. Lines 40 shown on the board 24 in FIG. 1 are representative of conductive paths that extend from each of the switches to the opposite end portions of the board 24 where connectors, such as conventional dual in line packaged connectors or the like are utilized to interconnect the printed conductors with flexible insulated conductors which are grouped in a bundle 44 shown in the left portion of FIG. 1 which extend to the cassette recording device (not shown) or other recording or storage apparatus. The apparatus preferably utilizes other switches 46 to decode additional functional operations, such as carriage return, back space, tabulator bar operation and the like and these switches 46 are also connected by conductors 48 to the aforementioned recording device.

Turning now to the enlarged views of the apparatus shown in FIGS. 2–4, the board has a number of apertures 50 which are adapted to receive the conductive leads of the switches 32 which are preferably soldered therein. The printed circuit or conductive paths preferably extend to the apertures so that soldering of the leads provides electrical continuity between the leads 52 and the switches in addition to securing the switches to the board. The switches are relatively small, magnetically actuated reed switches that preferably have normally open contacts and which will be actuated when a magnet is brought into close proximity to them. In this regard, the switches are preferably glass encapsulated, but may be encapsulated in other suitable material that will not detrimentally affect the magnetic actuation and will provide physical protection. The switches have a single pair of contacts that will close in the presence of a magnetic strength within the range of about 15 to about 45 gauss.

To actuate the reed switches, each of the actuating levers is provided with a permanent magnet 56 having opposite magnetic poles at opposite end portions thereof and having a magnetic force generally within the aforementioned range necessary to operate the reed switches 32 when the magnet is moved into close proximity to one of them. The magnet is secured to the end of the actuating lever 34 by adhesive bonding at the interface and may have an elastic band 60 as well. The actuating levers 34 are relatively thin and have generally L-shaped configuration as shown in FIG. 3. The levers are pivotable around a pivot shaft 62 that extends generally the full length of the board 24 with the shaft 62 passed through an aperture 64 in each of the levers 34, the aperture being located near the base or shorter portion as shown. A small aperture 66 is also provided that is adapted to receive an end portion of a spring 68 which is mounted upon the end of the linkage member 36 of the typewriter key mechanism. The downward movement of the linkage member 36 in response to striking a typewriter key causes the spring 68 to pivot the lever 34 and bring the magnet 56 into close proximity to the magnetically actuated switch 32. The levers 34 are preferably aligned with the center of the switches 32 and are suitably spaced apart from one another as shown. To maintain the proper spacing between adjacent levers 34, hollow sleeves 70 which fit around the shaft and loosely contact the side of the levers may be provided or, alternatively, an aluminum block or the like having slots cut therein with a width slightly larger then the width of the levers and a spacing to align them with the reed switches may be provided. The spacing between adjacent switches 32 is largely a function of the structural design of the typewriter itself and the actuating levers and switches are aligned with the corresponding linkage members 36 of the typewriter. A magnetic shield 74 having upward extensions 74 may be provided between each of the switches 32 to minimize the influence of a magnet on more than the desired switch it is intended to actuate.

Figure 5:
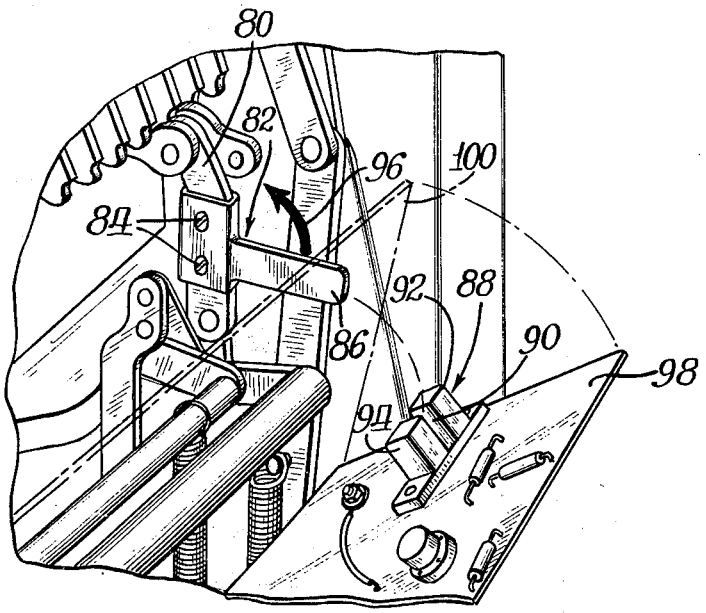
FIG. 5 is a perspective view of a portion of the apparatus embodying the present invention shown together with a typewriter; and, FIG. 6 is an electrical schematic diagram of a portion of the apparatus of the present invention.
Figure 6:
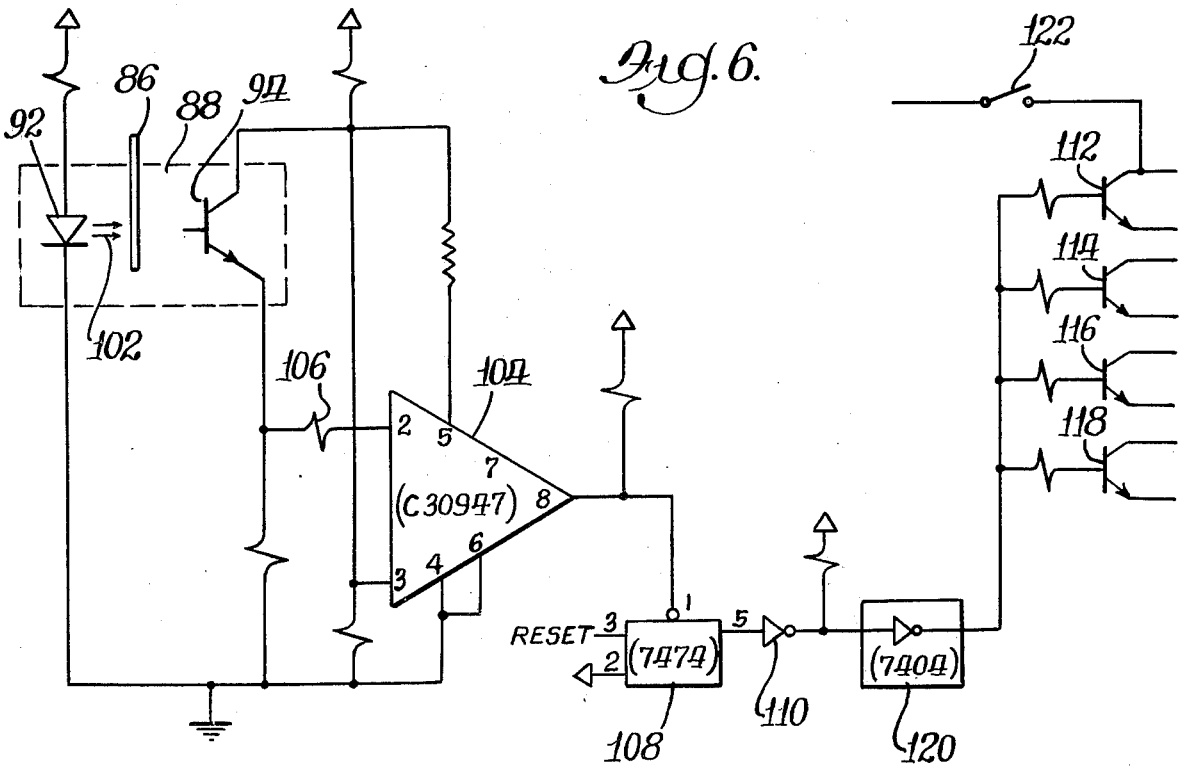

In accordance with the present invention, apparatus is shown in FIGS. 5 and 6 for use in the general environment of the apparatus disclosed in U.S. Pat. No. 3,972,403 that is shown in FIGS. 1–4. The perspective view shown in FIG. 5 and the electrical circuit schematic of FIG. 6 illustrate portions of the apparatus embodying the present invention which effectively substantially minimizes if not eliminates the possibility that an electrical signal identifying a specific character or functional operation could be produced without that character or functional operation occurring on the typewriter. In other words, an indication of the letter X, for example, being electrically produced could not occur unless it is actually typed by the typewriter. Referring to the structure shown in FIG. 3, it should be appreciated that in the event the linkage member 36 is moved downwardly as shown by the arrow in FIG. 3 in response to the pressing of its associated key on the typewriter keyboard, the L-shaped lever 34 will be moved to the left as shown in FIG. 3 into contact with the retaining block 72 so that the magnet 56 is brought into close proximity with the reed switch 32 to close an electrical circuit that identifies that key. It should be appreciated that the linkage member 36 could be moved downwardly a distance to bring the magnet in sufficiently close relationship to actuate the switch 32, but fail to engage the mechanical portions of the typewriter so as to cause the key to strike that platen and type the character. In other words, it is possible that an electrical trip could occur without a mechanical trip. If this would occur, the typist would generally have no knowledge that an error was produced in the sense that unwanted characters or functions may be recorded on the recording apparatus even though the copy that is being typed by the typewriter is clean.

To insure that an electrical trip occurs only when a mechanical trip happens, the apparatus of the present invention inhibits the generation of electrical signals that uniquely define the character or function until a mechanical trip occurs. In this regard, the ribbon advance mechanism represents a convenient mechanical takeoff for performing this function, since the ribbon advance mechanism typically operates only when the universal bar triggers the escapement of the typewriter. Thus, while the ribbon advance mechanism is a convenient from which to obtain a mechanical indication that a character has been typed or a function has occurred, any suitable linkage or mechanism that operates from the escapement mechanism could be utilized in a manner that will be hereinafter described.

Referring to FIG. 5, the ribbon advance mechanism includes a lever 80 to which a flag member 82 is attached by any conventional means such as screws 84 or the like. The outer end 86 of the flag member 82 is positioned so as to be movable into and out of a light circuit of an optical coupler 88 which has a gap 90 between a light emitting diode portion 92 located on one side of the gap and a phototransistor portion 94 located on the opposite side. When the flag 86 is positioned in the gap 90, the light from the light emitting diode 92 is blocked and thereby shuts off the phototransistor 94. When the typewriter is not being used, the flag member has the outer end 86 normally positioned in the gap 90 so as to block the light. When the typewriter is actuated by striking a character or functional key or bar so that the universal bar will trigger the ribbon advance mechanism and move the end 86 out of the gap 90 in the direction of the arrow 96. It should also be understood that the optical coupler 88 is mounted on a printed circuit board 98 which is shown in a generally unassembled position with respect to the typewriter, it being mounted generally in the position shown in phantom at 100 when it is secured to the typewriter. Thus, when it is in the position shown in phantom, the optical coupler 88 will be in close proximity to the end 86 of the flag member 82 so that when it is moved, the above described action will occur.

Turning now to the electrical diagram of FIG. 6, the end 86 of the flag member 82 is schematically shown in the gap or space between the light emitting diode 92 and the phototransistor 94 of the optical coupler shown inside of the dotted line. When the end 86 is in the gap 90, the light indicated by the small arrows 102 is blocked and is not received by the phototransistor 94 which is biased so as to being nonconducting in the absence of receiving light. When the end 86 is moved out of the gap, the light causes the phototransistor 96 to become conductive and the emitter thereof is connected to an amplifier 104 through resistor 106. The output of the amplifier 104 is applied to a flip-flop 108 and its output is inverted by inverter 110. The output of the inverter 110 is connected to the base of transistors 112, 114, 116 and 118 through a driver 120. The operation of the circuit is such that when transistor 94 is switched into conduction, the amplifier output which is normally high is switched low to actuate the flip-flop 108 which goes high. The high signal is twice inverted by the inverter 110 and driver 112 so that the bases of the transistors 112–118 are switched high and are placed into conduction. The transistors 112–118 comprise the switching element for supplying power to the columns of the switching matrix which generate the coded signals identifying the characters or functional operation that are recorded by the recording apparatus. Thus, the electrical signals are not produced until the transistors 112–118 are energized.

In certain instances, such as when the space, back space, tab, shift and similar operations are performed, the switches such as switch 122 may be provided to bypass a transistor such as transistor 112 depending upon which column the particular functional operation is located, the bypassing operation being possible because it is operated by the power arm of the typewriter and it would be impossible to provide an electrical trip without a mechanical trip. In other words, the switch 122 is closed due to the occurrence of the mechanical operation that is desired.

In accordance with yet another important aspect of the present invention, provision is made for preventing the signals identifying more than one character from being electrically generated when the flag member end 86 is moved out of the gap 90. Thus, it is impossible to provide two rapidly occurring character identifying signals when only one character is actually typed by the typewriter. To prevent such rapid generation of false electrical signals indicative of a character or function from occurring, the recording apparatus normally provides a signal when it receives and identifies a matrixed signal indicative of a character or function and this signal from the tape recorder is used to reset the flip-flop 108 at pin no. 3. For another signal to be passed through the circuitry, it is necessary for the flag member end 86 to be moved out of the light circuit so as to turn on the phototransistor 94 in the manner as previously described.

From the foregoing detailed description it should be understood that the apparatus of the present invention, in addition to permitting a conventional typewriter to perform the additional of generating a magnetic tape recording or the like of the information that is being typed, also prohibits the generation of spurious, unknown electrical signals that are caused by leaning on the typewriter keys without causing the typewriter to type or by hitting two keys within a very close time span wherein only one will cause the typewriter to type, and other similar events that often occur during typing. By coupling the mechanical and electrical actuation of the typewriter, the information that is recorded by the recording device provides a true representation of what appears on the paper as it is being typed.

It should be understood that although preferred embodiments of the present invention have been illustrated and described, various modifications thereof will become apparent to those skilled in the art and, accordingly, the scope of the present invention should be defined only by the appended claims and equivalents thereof.

Various features of the invention are set forth in the following claims.

What is claimed is:

1. Apparatus for attachment to a typewriter for selectively actuating a plurality of electrical switch means in response to depressing the keys of typewriter, comprising, in combination:

support means for attachment to the underside of the typewriter generally beneath the keyboard thereof, said support means being adapted to support a plurality of switch means adjacent one another;

a plurality of first electrical switching means that are connected in electrical circuits that are matrixed in rows and columns, and adapted to produce electrical signals identifying the key being depressed when switched, said switching means being positioned adjacent one another and extending along said support means generally across the width of the keyboard;

a plurality of pivotable actuating levers positioned adjacent said switching means, each of said levers being operably associated with a key of the typewriter and with one of said switching means so that pivotal movement of one of said actuating levers occurs in response to depression of its associated typewriter key, said actuating levers actuating its associated switching means;

means operably associated with the universal bar mechanism of the typewriter, said means being movable in response to the universal bar triggering the escapement mechanism of the typewriter;

second switching means being operated by said universal bar mechanism associated means;

circuit means associated with said second switching means and said first switching means adapted to inhibit the receipt of said electrical signals by said matrixed electrical circuits from said first switching means until said second switching means is actuated, said signals thereby being inhibited unless and until a character is typed.

2. Apparatus as defined in claim 1 wherein said first switching means comprise magnetically actuated switches, each of said actuating levers having a magnet thereon for actuating its associated switch when brought into close proximity thereto.

3. Apparatus as defined in claim 1 wherein said means operably associated with said universal bar mechanism comprises a flag member connected to a portion of the mechanism that triggers the ribbon advance of the typewriter.

4. Apparatus as defined in claim 3 wherein said second switching means comprises an opto-electronic coupler adapted to open and close an electrical switch in response to unblocking and blocking a light circuit.

5. Apparatus as defined in claim 4 wherein said opto-electronic coupler comprises a light emitting diode and a phototransistor adapted to be placed into conduction when the light from said diode is received, said flag member being positioned so that it normally blocks the light circuit between said diode and phototransistor and unblocks the same when said ribbon advance is triggered.

6. Apparatus as defined in claim 5 wherein said circuit means is operable to inhibit said electrical signals from being produced by said first switching means until said phototransistor is placed into conduction, said circuit means including third switching means adapted to control the operation of said matrixed electrical circuits.

7. Apparatus as defined in claim 6 wherein said third switching means comprise switching transistors connected to the columns of the matrix circuits so that when said switching transistors are nonconductive, said electrical signals from said first switching means are inhibited.

8. Apparatus as defined in claim 6 wherein said circuit means includes resetable switching element located intermediate said phototransistor and said third switching means, said switching element permitting said third switching means to be conductive for predetermined time required to pass the electrical signals identifying one of said keys, the element being required to be reset before it permits said third switching means to again be switched into conduction.

9. Apparatus as defined in claim 6 including fourth switching means adapted to bypass selective ones of said third switching means said fourth switching means being operated by predetermined functional operation keys of the typewriter.

* * * * *